US006133678A

United States Patent [19]

Kishino et al.

[11] Patent Number: 6,133,678

[45] Date of Patent: Oct. 17, 2000

[54] FIELD EMISSION ELEMENT

[75] Inventors: Takao Kishino; Kazuhiko Tsuburaya; Hisataka Ochiai; Takahiro Niiyama; Masaharu Tomita, all of Mobara, Japan

[73] Assignee: Futaba Denshi Kogyo K.K., Mobara, Japan

[21] Appl. No.: 09/072,665

[22] Filed: May 5, 1998

[30] Foreign Application Priority Data

May 7, 1997 [JP] Japan ..... 9-116965

[51] Int. Cl.[7] ..... H01J 1/30

[52] U.S. Cl. ..... 313/309; 313/336; 313/351; 313/495

[58] Field of Search ..... 313/309, 336, 313/351, 310, 495, 496, 497, 306; 315/169.1

[56] References Cited

U.S. PATENT DOCUMENTS 5,600,203 2/1997 Namikawa et al. ..... 313/495
5,650,689 7/1997 Itoh et al. ..... 313/309
5,747,927 5/1998 Namikawa et al. ..... 313/495
5,838,095 11/1998 Tanaka et al. ..... 313/309
5,955,850 9/1999 Yamaguchi et al. ..... 313/495

*Primary Examiner*—Ashok Patel
*Attorney, Agent, or Firm*—Oblon, Spivak, McClelland, Maier & Neustadt, P.C.

[57] ABSTRACT

A field emission element in which a cathode substrate and an anode substrate are spaced from each other and are hermetically sealed. The field emission element comprises cathode electrodes and gate terminals formed on the cathode substrate; an insulating layer overlaying the cathode electrodes and the gate electrodes, the cathode electrodes and the gate terminals being partially extracted outward from the insulating layer, gate electrodes formed on the insulating layer, wherein the gate electrodes are arranged so as to cross said cathode electrodes at intersections, openings each being formed through a cathode electrode and an insulating layer at each of the intersections, a resistance layer at least formed on a part of each of the cathode electrodes, and emitter electrodes each electrically connected to a cathode electrode via the resistance layer formed within an opening. Each of the gate electrode is electrically connected to a corresponding one of the gate terminals via a through hole formed in the insulating layer.

5 Claims, 5 Drawing Sheets

FIELD EMISSION ELEMENT

BACKGROUND OF THE INVENTION

1. Field of the Invention

This invention relates to a field emission element.

2. Description of the Related Art

When the electric field at the surface of a metal or semiconductor is as large as $10^9$ V/m, electrons pass through the potential barrier because of the tunnel effect, thus entering an evacuated space at room temperatures. This phenomenon is called field emission. The cathode which emits electrons utilizing that principle is referred to as a field emission cathode (hereinafter referred to as FEC).

Recently, flat emission cathode FECs with micron structures have been able to be manufactured fully using semiconductor machining technology. Since elements each which has a great number of FECs acting as emitters formed on a substrate irradiate the fluorescent substance surface with electrons, they are used as electron emission sources for field emission displays (hereinafter merely referred to as FEDs), electron optical systems for lithography, or the like.

FIG. 7 is a perspective view schematically illustrating the basic structure of a Spindt field emission display. The field emission display includes a cathode substrate 1, cathode electrodes 2, gate electrodes 4, an insulating layer 8, openings 31, an anode substrate 32, and anode electrodes 33. The symbol A represents an anode lead-out conductor; C1 to Cn represent cathode lead-out conductors; and G1 to Gm represent gate lead-out conductors.

Stripe-shaped cathode electrodes 2 are arranged on the cathode substrate 1. The insulating layer 8 is formed to completely cover the cathode electrodes 8. Gate electrodes 4 are arranged in a stripe form on the insulating layer 8 in the direction perpendicular to the cathode electrodes 8. The so-called Spindt field emission cathode is used for the above-mentioned FEC. Plural openings 31 are formed at each of intersections where the cathode electrodes 2 cross the gate electrodes 4 so as to penetrate the gate electrode 4 and the insulating layer 8 underlying the same. The cone electrode 5 (to be described later with reference to FIG. 9) is formed on the cathode electrode 2 in each opening. The cone electrode 5 acts as an emitter electrode.

The anode electrode 33 and a fluorescent substance layer (not shown) are formed on the lower surface of the anode substrate 32 such as a glass substrate. A positive voltage is applied on the anode electrode 33 via the anode lead-out conductor A. Image signals are respectively applied to the cathode electrodes 2 via the cathode lead-out conductors C1 to Cn. Drive signals are respectively supplied to the gate electrodes 4 via the gate lead-out electrodes G1 to Gm. In a display operation, the cone electrode disposed within each of the openings 31 emits electrons to glow the fluorescent substance coated on the anode electrode 33. In the case of the three primary color field emission display, stripe-shaped anode electrodes 33 corresponding to fluorescent substance luminous colors (not shown) are arranged in parallel to the cathode electrodes 2 and are connected to different anode lead-out conductors.

FIG. 8 is a plan view schematically illustrating the basic structure of a Spindt field emission display. Like numerals represent the same constituent elements as those shown in FIG. 7 and hence the duplicate description will be omitted. Numeral 6 represents a seal and 34 represents an insulating support.

Plural insulating supports 34 are set up on the insulating layer 8 (shown in FIG. 7) to sustain the gap between the cathode substrate 1 and the anode substrate 32 to a predetermined distance against the atmosphere pressure. The inside of the assembly is maintained at a high vacuum by placing the seal 6 such as a low melting point seal glass (e.g. fritted glass) and then thermally welding it.

In FIG. 8, the seal 6 is depicted to be somewhat to the inside from the fringe of the overlapped portion. However, in actual, the seal 6 is welded over the fringe or the area adjacent to the same. Cathode terminals C led out of the cathode electrodes 2 are arranged on the lower end portion of the cathode substrate 1. Similarly, gate terminals are arranged on the insulating layer 8 (shown in FIG. 7) overlaying the left end portion of the cathode substrate 1. An anode terminal A extending from the anode electrode 33 is formed on the upper end portion of the anode substrate 32.

FIG. 9 is a cross-sectional view illustrating a conventional field emission cathode and partially taken along one gate electrode 4. Referring to FIG. 9, like numerals represent the same constituent elements as those in FIG. 7. Numeral 3 represents a resistance layer; 5 represents a cone electrode; 6 represents a seal; and 41 represents a seal protective layer.

Cathode electrodes 2 of aluminum is formed on the cathode substrate 2 such as a glass. A resistance layer 3 of amorphous silicon (a-Si) is formed so as to cover each cathode electrode 2. An insulating layer 8 such as silicon dioxide ($SiO_2$) film is formed on the resistance layers 3 and the area where the cathode electrodes 3 and resistance layers 3 stripe-shaped are not formed.

Gate electrodes 4 are stripe-shaped on the insulating layer 8 in the direction perpendicular to the cathode electrodes 2. Each of cone electrodes 5 is positioned within the opening formed through each gate electrode 4 and the insulating layer 8 and is formed on the cathode electrode 2 via the resistance layer 3. The cone electrode 5 is made of a metal such as molybdenum. The tip of the cone electrode confronts the anode electrode 33 though the opening. In the figure, only one cone electrode 5 is depicted in the width direction of the anode electrode 2. However, a large number of cone electrodes 5 are formed on the anode electrode 2.

Since the distance between the gate electrode 4 and the tip of the cone electrode 5 is of the order of submicrons, the cone electrode 5 can field-emit electrons by applying a small voltage of several volts between the gate electrode 4 and the cone electrode 5. Thus, an electron emission source is formed of the cathode electrode 2, the cone electrode 5, and the gate electrode 4. The resistance layer 3 restricts an excessive current flowing through the cathode electrode 2.

With no resistance layer 3, if a discharge or short circuit occurs between the gate electrode 4 and the tip of one cone electrode 5 due to a certain cause, an excessive current may flow between the gate electrode 4 and the cathode electrode 2, thus resulting in a breakage of both the lines. The resistance layer 3 prevent such excessive current. Moreover, if there is a cone electrode 5 which tends to easily emit electrons among a large number of cone electrodes 5, electrons intensively emitted from the cone electrode 5 may produce an abnormal bright spot on the screen. When a cone electrode 5 starts to emit excessive current, the resistance layer 3 produces a voltage drop thereacross, thus decreasing the voltage to be applied to the cone electrode 5. As a result, the electron emission is suppressed so that the cone electrode 5 can stably emit electrons.

The gate electrodes 4 need to bridge the sealed portions of the seal 6 to be led out. However, the seal protective layer 41 which covers the gate electrodes 4 at the sealed portion is made of silicon dioxide ($SiO_2$). The seal protective layer 41 is sealed with the seal 6. Niobium (merely abbreviated as Nb) is used for the material of the gate electrodes 4. With no seal protective layer 41, the gate electrodes 4 of niobium is in contact with the fritted glass being a material of the seal 6. In this case, the fritted glass oxidizes the gate electrodes 4 at the electrode lead-out portions during the heating process for sealing, thus delaminating the gate electrode 4 from the insulating layer 8. Such delamination causes the seal 6 to intrude into the split portion and finally occurs a slow leakage phenomenon by which the vacuum degree of the envelope decreases gradually in a long period of time. Furthermore, the oxidation cause either an increased resistance of the gate electrode or a conduction failure of the gate electrode 4 due to a line breakage. For that reason, the seal protective layer 41 is disposed to prevent the gate electrode 4 to be in contact with the seal 6.

In the conventional field emission cathode, since the gate electrodes 4 care formed on the insulating layer 8 and the terminals for the cathode electrodes 2 are formed on the cathode substrate 1, so that the gate terminals and the cathode terminals are formed on difference layers respectively. This requires implementing different lead-out fabrication steps. Moreover, in order to isolate the gate terminals from the seal 6, it is necessary to carry out the steps of depositing the seal protective layer 4 and then patterning the same. Hence, the problem is that the conventional manner leads to increasing the number of steps and complicating the fabrication process.

SUMMARY OF THE INVENTION

The present invention is made to overcome the above-mentioned problems. The object of the invention is to provide a field emission element in which terminals of cathode electrodes and terminals of gate electrodes are formed on the same plane, thus avoiding the increased steps and complicated fabrication process.

Another object of the present invention to provide a field emission element that can eliminate the protective films and can suppress excessive current due to conduction between the gate electrode and the cathode electrode, thus preventing the electron emitting portion from being destroyed.

According to a first aspect of the present invention, in a field emission element in which a cathode substrate and an anode substrate are spaced from each other and are hermetically sealed, the field emission element comprises cathode electrodes formed on the cathode substrate; gate terminals formed on the cathode substrate; an insulating layer overlaying the cathode electrodes and the gate electrodes, the cathode electrodes and the gate terminals being partially extracted outward from the insulating layer; gate electrodes formed on the insulating layer; wherein the gate electrodes are arranged so as to cross the cathode electrodes at intersections, openings each being formed through a cathode electrode and an insulating layer at each of the intersections; a resistance layer at least formed on a part of each of the cathode electrodes; and emitter electrodes each electrically connected to a cathode electrode via the resistance layer formed within an opening; wherein each of the gate electrode is electrically connected to a corresponding one of the gate terminals via a through hole formed in the insulating layer.

Hence, terminal conductors can be led out on the same plane. The resistance layer can suppress an excessive current flowing between a cathode electrode and an emitter electrode, thus preventing a breakage of an electrode and enabling a stable electron emission operation. The insulating layer covering the gate electrodes insulates the seal from the gate electrodes, so that the protective film can be omitted.

According to a second aspect of the present invention, in a field emission element in which a cathode substrate and an anode substrate are spaced from each other and are hermetically sealed, the field emission element comprises cathode electrodes formed on the cathode substrate; gate terminals formed on the cathode substrate; an insulating layer overlaying the cathode electrodes and the gate electrodes, the cathode electrodes and the gate terminals being partially extracted outward from the insulating layer; gate electrodes formed on the insulating layer; wherein the gate electrodes are arranged so as to cross the cathode electrodes at intersections, openings each being formed through a cathode electrode and an insulating layer at each of the intersections; emitter electrodes each formed in a corresponding one of the openings and electrically connected to a corresponding one of the cathode electrodes; a resistance layer at least formed on a part of each of the gate terminals; and wherein each of the gate electrodes is electrically connected to a corresponding one of the gate terminals via the resistance layer in a through hole formed in the insulating layer.

Hence, terminal conductors can be led out on the same plane. The resistance layer can suppress an excessive current flowing between a cathode electrode and an emitter electrode, thus preventing a breakage of an electrode and enabling a stable electron emission operation. The resistance layer can also suppress an excessive current flowing between an anode electrode and a gate electrode. Since any current does not normally flow through the gate electrode, a voltage drop across a resistance layer in the through hole as well as an increase in power consumption thereof can be ignored. For that reason, the resistance value of the resistance layer can be set to a relatively large value. Since the gate terminals are covered with an insulating layer, the protective layer used in the conventional way can be omitted.

According to the third aspect of the present invention, in a field emission element in which an anode substrate and an anode substrate are spaced from each other and are hermetically sealed, the field emission element comprises cathode electrodes formed on the cathode substrate; gate terminals formed on the cathode substrate and each having a connection portion separated with a gap; an insulating layer overlaying the cathode electrodes and the gate terminals, the cathode electrodes and the gate terminals being partially extracted outward from the insulating layer; gate electrodes formed on the insulating layer; wherein the gate electrodes are arranged so as to cross the cathode electrodes at intersections, openings each being formed through a cathode electrodes and an insulating layer at each of the intersections; emitter electrodes respectively formed in a corresponding one of the openings and electrically connected to a corresponding one of the cathode electrodes; and a resistance layer formed at least in the gap; wherein each of the gate electrodes is electrically connected to a corresponding one of the connection portions via a through hole formed in the insulating layer.

Hence, terminal conductors can be led out on the same plane. The resistance layer in the gap can suppress an excessive current flowing between an emitter electrode and a gate electrode, thus preventing a breakage of an electrode and enabling stable electron emission. The resistance layer can also prevent the excessive current flowing between said anode electrode and a gate electrode. A voltage drop across the resistance layer in the gap as well as an increase in power consumption thereof can be ignored, the resistance value of the resistance layer can be set to a relative large value. By varying the width of the gap, the resistance value can be widely controlled, for example, to a value suitable to the gate protective resistance. The insulating layer covers the gate electrodes, so that the protective film can be omitted.

According to a fourth aspect of the present invention, in a field emission element in which a cathode substrate and an anode substrate are spaced from each other and are hermetically sealed, the field emission element comprises cathode electrodes formed on the cathode substrate; gate terminals formed on the cathode substrate and each having a connection portion separated with a gap; an insulating layer overlaying the cathode electrodes and the gate terminals, the cathode electrodes and the gate terminals being partially extracted outward from the insulating layer; gate electrodes formed on the insulating layer; wherein the gate electrodes are arranged so as to cross the cathode electrodes at intersections, openings each being formed through a cathode electrode and an insulating layer at each of the intersections; emitter electrodes respectively formed in a corresponding one of the openings and electrically connected to a corresponding one of the cathode electrodes; a resistance layer formed at least on a part of a corresponding one of the gate terminals and in the gap; wherein each of the gate electrodes is electrically connected to a corresponding one of the connection portions via the resistance layer in a through hole formed in the insulating layer.

Hence, terminal conductors can be led out on the same plane. The resistance layer in the through hole and the resistance layer in the gap can suppress an excessive current flowing between an emitter electrode and a gate electrode, thus preventing a breakage of an electrode and enabling stable electron emission. The resistance layer can also prevent the excessive current flowing between said anode electrode and a gate electrode. A voltage drop across the resistance layer in the through hole and the gap as well as an increase in power consumption thereof can be ignored, the resistance value of the resistance layer can be set to a relative large value. By varying the gap, the resistance value can be widely controlled, for example, to a value suitable to the gate protective resistance. The insulating layer covers the gate electrodes, so that the protective film can be omitted.

In the field emission element of the present invention, the through holes and the gap are formed at a common position, and each of said gate electrodes is electrically connected to a corresponding one of the gate electrodes via the resistance layer in the through hole.

Hence, the resistance layer can be widely set to lower resistance values, compared with the case where the resistance layer in the through hole and the resistance layer across the gap are differently fabricated.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 6(*b*) is a plan view illustrating a gate terminal shown in FIG. 6(*a*);

DETAILED DESCRIPTION OF THE PREFERRED EMBODIMENTS

The embodiments according to the present invention will now be described below in detail with reference to the attached drawings.

Figure 1:
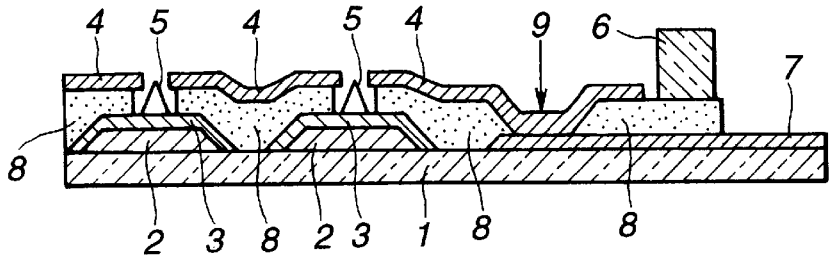
FIG. 1 is a cross-sectional view illustrating a field emission element according to a first embodiment of the present invention.
Figure 7:
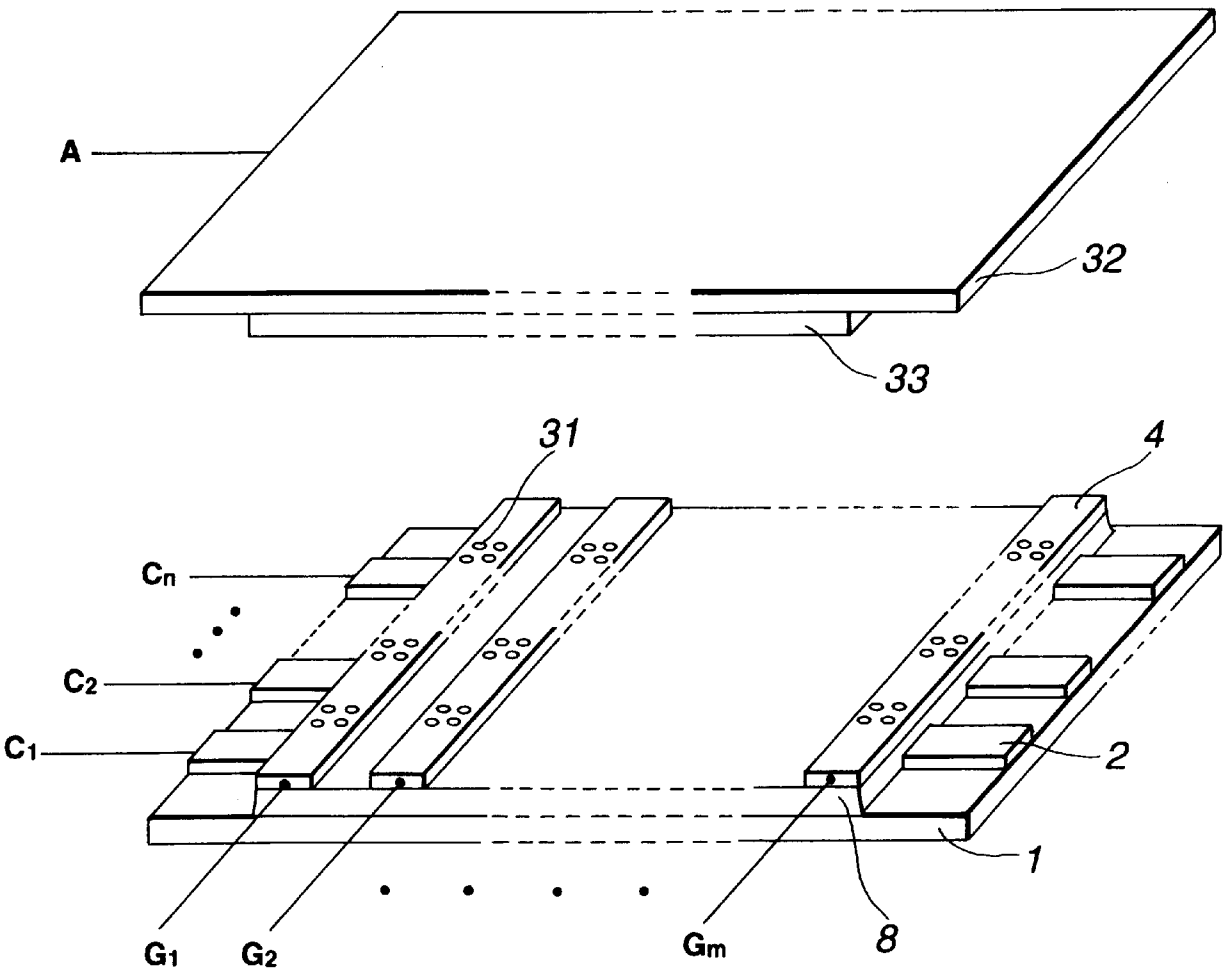
FIG.7 (PRIOR ART)
FIG. 7 is a perspective view schematically illustrating the basic configuration of a Spindt field emission display.
Figure 8:
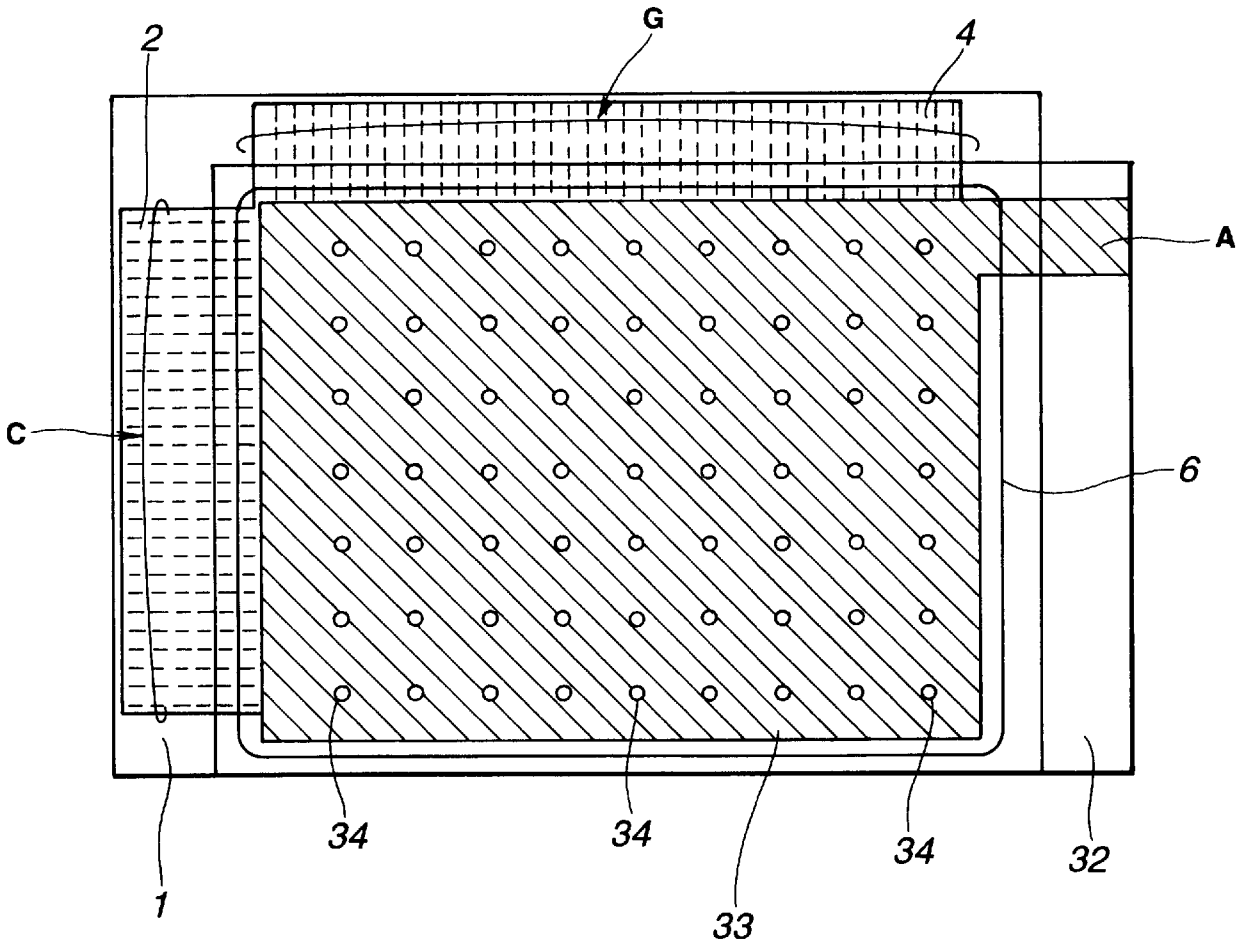
FIG.8 (PRIOR ART)
FIG. 8 is a perspective view schematically illustrating the basic configuration of a Spindt field emission display.
Figure 9:
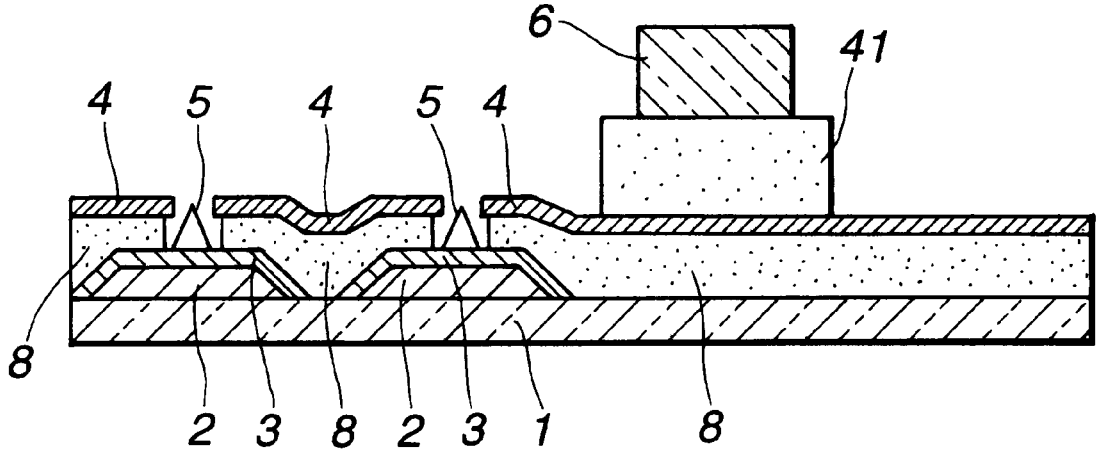
FIG.9 (PRIOR ART)
FIG. 9 is a cross-sectional view illustrating a conventional field emission cathode.

FIG. 1 is a cross-sectional view illustrating a field emission electrode according to an embodiment of the present invention. Like numerals represent the same constituent elements as those in FIGS. 7 and 9 and hence the duplicate description will be omitted here. Numeral 7 represents a gate terminal and 9 represents a through hole.

The field emission element of the present embodiment has the basic configuration applicable to embodiments to be described later. The field emission element differs from the conventional field emission element shown in FIG. 9 in the structure where the gate terminals 7 are led out. The present embodiment lacks the seal protective layer 4 seen in FIG. 9.

Gate terminals 7 are formed on the cathode substrate 1 to lead out of gate electrodes 4, together with cathode terminals (not shown) lead out of cathode electrodes 2. Through holes 9 are formed in the insulating layer 8. In such a laminated wiring structure, each of the gate electrodes 4 overlaying the insulating layer 8 is partially connected to the corresponding gate terminal 7 on the cathode substrate 1 via the through hole 9. Thus, the gate terminals 7 as well as the cathode terminals (not shown) can be arranged on the same surface of the cathode substrate 1. This structure can prevent an increased number of the fabrication steps and the complicated fabrication process.

The insulating layer 8 formed beneath the seal 6 isolates the seal 6 from the gate electrodes 4 and the gate terminals 7, so that the problem does not occur that the gate 4 and the gate terminal 7 may be peeled off from the insulating layer 8. Hence, this procedure can reduce the steps of depositing the seal protective layer and then patterning the seal protective layer 41, shown in FIG. 9. In this embodiment, the seal protective layer 41 is not particularly required but may be formed to reinforce the insulating layer 8.

When a short circuit is accidentally formed between the cone electrode 5 and the gate electrode 4, the resistance layer 3 sandwiched between the cathode electrode 2 and the cone electrode 5 can prevent occurrence of excessive current, thus preventing the electron emitting portion from being destroyed. In this embodiment, the excessive current prevention realized by only the resistance layer 3 between the cathode electrode 2 and the cone electrode 5 is suitable when the resistance added to the gate electrode 4 is reduced to improve the gate switching response. Amorphous silicon (a-Si) may be used as the resistance layer 3.

The fabrication process of the above-mentioned structure will be described in detail here. The lines of cathode electrodes 2 and the lines of gate terminals 7 perpendicular to the lines of the cathode electrodes 2 are formed on the cathode substrate 1 by sputtering a metal thin film and then patterning it. Next, a thin film of amorphous silicon (a-Si) is deposited through a sputtering process to form a resistance layer 3. Using the photolithographic technique, resistance layers 3 are formed to cover the lines of the cathode electrodes 2 by patterning the amorphous thin film through the RIE (Reactive Ion Etching) process. Next an insulating layer 8 is formed and then through holes 9 are patterned in the insulating layer 8. The through holes 9 may be respectively formed in gate terminals 7, or may be formed in common for all gate terminals 7.

After the formation of the insulating layer 8 and the through holes 9, a gate film is formed by sputtering, for example, niobium (Nb). Then, the gate film is patterned to form gate electrodes 4. The gate electrodes 4 are connected to the gate terminals 7 by vapor-depositing the gate film into the through holes 9. Good electrical connection is accomplished by gradually sloping the aperture angle of the through hole 9. The sharp aperture angle of the through hole may cause a connection failure. However, even in the case of the through hole with a sharp aperture angle, good electrical connection may be accomplished using a two-layered structure of the gate layer and a niobium film formed through the swivel, oblique vapor-depositing step.

Thereafter, cone electrodes 5 are respectively formed within the through holes by forming a peeling layer on the surfaces of the gate electrodes 4 by the swivel, oblique vapor-deposition from above the gate electrodes 4 and then depositing a cone layer overlaying the peeling layer. Then, after the peeling layer and the cone layer thereon are removed together, the lead-out conductors are derived from the cathode terminals and the gate terminals 7 through the insulating layer 8 by patterning the insulating layer 8. Finally, a field emission element is formed as shown in FIG. 1. The end of each of the cathodes 2 acts as a cathode terminal.

The fabrication costs can be effectively reduced by omitting the steps including the step of forming the seal protective layer 6 and the step of deriving terminals from the cathode electrodes 2 and the gate electrodes 4. In concrete, the through hole 9 with a diameter of about 50 $\mu$mϕ provides a sufficient low contact resistance of less than 2 kΩ, thus resulting in no degradation of the switching characteristics.

Figure 2:
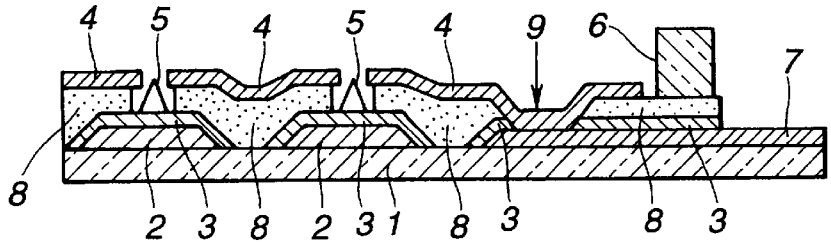
FIG. 2 is a cross-sectional view illustrating a field emission element according to a second embodiment of the present invention.

FIG. 2 is a cross-sectional view illustrating a field emission element according to the second embodiment of the present invention. In FIG. 2, like numerals represent the same constitute elements as those in FIGS. 1, 7, and 9. Hence, the duplicate description will be omitted here.

In the field emission element of the second embodiment, the lines of the gate electrodes 4 are respectively connected to the gate terminals 7 through holes 9, like the structure of FIG. 1. However, the protective layer 8 is formed with the resistance layer 3 formed on the line extending from the gate terminal 7. The structure of the present embodiment is fabricated by forming through holes each which penetrates the insulating layer 8 and the resistance layer 3 while the contact hole 9 is being formed. The resistance layers 3 as well as the protective layers 8 are simultaneously removed when the terminals are extended from the ends of the gate terminals 7.

In the present embodiment, it is unnecessary that the area where the resistance layers 3 are left in the patterning step is not limited to the line of the cathode electrode 2. This eases the step of forming the resistance layer 3. The gate terminal 7 is protected from the seal 6 by the two-layered structure formed of the insulating layer 8 and the resistance layer 3.

Figure 3:
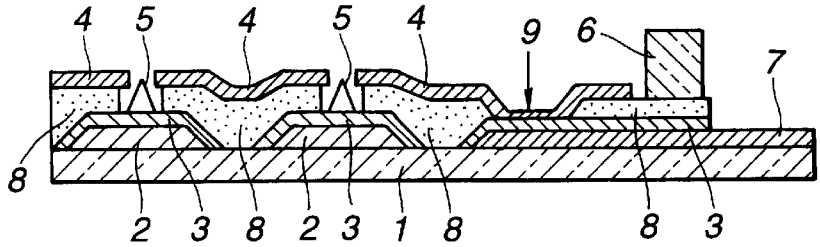
FIG. 3 is a cross-sectional view illustrating a field emission element according to a third embodiment of the present invention.

FIG. 3 is a cross-sectional view illustrating a field emission element according to the third embodiment of the present invention. Like numerals represent the same constituent elements as those shown in FIGS. 1, 7, and 9 and hence the duplicate description will be omitted here.

Compared with the embodiment shown in FIG. 2, the field emission element has the structure where the resistance layer 3 is sandwiched between the gate terminal 7 and the gate electrode 4 within the through hole 9.

In such a structure, a resistance layer is formed between the gate terminal 7 and the line of the gate electrode 4, and acts as a gate line protective resistance, in cooperation with the resistance layer 3 between the cathode electrode 2 and the cone electrode 5. The excessive current between the gate electrode 4 and the cathode electrode 2 due to an insulation failure produces a voltage drop therebetween. This can protect the electron emission portion from breakage due to the excessive current. Moreover, the resistance layer inserted between the gate electrode 4 and the gate terminal 7 acts as an excessive current protective resistance between the gate electrode and the cathode electrode and as an excessive current protective resistance between the anode electrode and the gate electrode.

The resistance layer 3 between the cathode electrode 2 and the cone electrode 5 cannot be set to a large resistance value because it normally receives a large current, thus producing a voltage drop and power consumption. In contrast, since no current normally flows the line of the gate electrode 4, an increase in voltage drop or power consumption due to the resistance layer 3 within the through hole 9 can be ignored. Hence, the resistance value can be set to a relatively large value. The switching characteristics of the gate electrode is somewhat deteriorated due to the resistance layer 3 within the through hole 9, but it can be sufficiently suppressed by decreasing the electrostatic capacitance between the gate electrode 4 and the cathode electrode 2.

In this embodiment, the resistance layers 3 are left beneath the cone electrodes 5 and on the gate terminals 7 during the patterning process. In the step of forming the through holes 9, the resistance layers 3 therein are left by selectively etching only the insulating layer 8. The junction within the through hole 9 has the structure where the resistance layer 3 is sandwiched between the gate electrode 4 and the gate terminal 7. As a result, the step of forming the insulating layer 3 using etching is not particularly required together with the processes including the step of forming the seal protective layer, the gate terminal leading step, and the like. The resistance between the line of the gate terminal 7 and the line of the gate electrode 4 has a resistance value of several kΩ to several tens kΩ.

Figure 4:
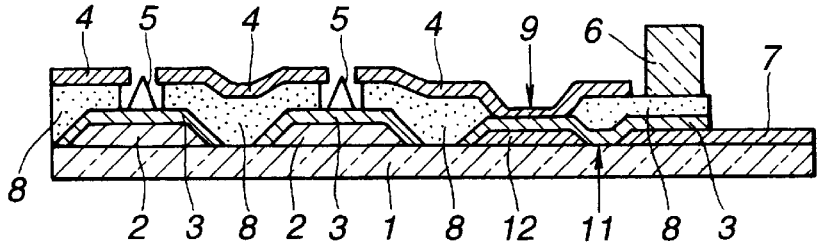
FIG. 4 is a cross-sectional view illustrating a field emission element according to a fourth embodiment of the present invention.

FIG. 4 is a cross-sectional view illustrating a field emission element according to the fourth embodiment of the present invention. Like numerals represent the same constituent elements as those shown in FIGS. 1, 7, and 9 and hence the duplicate description will be omitted here. Numeral 11 represents a gap and 12 represents a gate terminal isolation region.

Unlike the third embodiment shown in FIG. 3, the field emission element of the fourth embodiment has the gap 11 newly formed in the middle portion of the line of each of the gate terminals 7 to separate the terminal lead-out conductor from the portion on the side of the through hole 9. The resistance layer 3 is buried in the gap 11.

In FIG. 4, the region under the through hole 9 is shown as a gate terminal separation portion 12. Excessive current protection can be realized by the resistance layer 3 in the gap 11 of the gate terminal 7, in cooperation with the resistance layer 3 between the cathode electrode 2 and the cone emitter 5 and the resistance layer 3 in the through hole 9. The gap 11 may be formed in the line of the gate terminal 7 when the niobium film is patterned on the cathode substrate 1.

Hence, in the field emission element of the present embodiment, while the amorphous silicon film is patterned to form the resistance layers 3 to be formed beneath the cone electrode 5, it is selectively left to form the resistance layer 3 on the gate electrode 7 and in the gap 11. This embodiment does not increase the fabrication step. Hence, the steps is omitted including the step of forming the seal protective layer, the step of extracting the gate terminal, or the like whereas it is not particularly required to perform the step of selectively etching the resistance layer 3 when the through holes 9 are formed.

The resistance value of the resistance layer 3 can be widely controlled by the step of changing the width of the gap 11, that is, the spacing between the gate terminals 7 in the line direction, in comparison with the step of controlling the thickness of the resistance layer 3 within the through hole 9. The gate protective resistance can be set to a suitable value without being limited by the resistivity of the resistance layer 3 being the resistance beneath the cone terminal 5. The resistance between gate electrode 7 and the gate electrode 4 can be controlled from several kΩ to several 100 MΩ. An increased resistance can more effectively function as an excessive current protective resistor. Since no current normally flows through the gate electrode 4, an increase of power consumption can be substantially ignored. Deterioration of the switching characteristics of the gate electrode 4 can be prevented by sufficiently minimizing the electrostatic capacitance between the gate electrode 4 and the cathode electrode 2.

The fifth embodiment corresponds to a modification of the above-mentioned embodiments. The resistance layer 3 within the through hole 9 shown in FIG. 4 is removed in a similar manner to those shown in FIGS. 1 and 2. The same effect as those in the above-mentioned embodiments can be obtained by the fifth embodiment. In this case, the excessive current protection can be accomplished by the resistance layer 3 between the cathode electrode 2 and the cone emitter 5 and the terminal resistance being the resistance layer 3 in the gap 11. The resistance value is nearly set at an intermediate value between the resistance value of the sole resistance layer in the first embodiment shown in FIG. 1 or the second embodiment shown in FIG. 2 and the sum of the resistance value of the electrode-to-electrode resistance layer and the resistance value of the electrode-to-terminal resistance layer in the third embodiment shown in FIG. 3.

Figure 5:
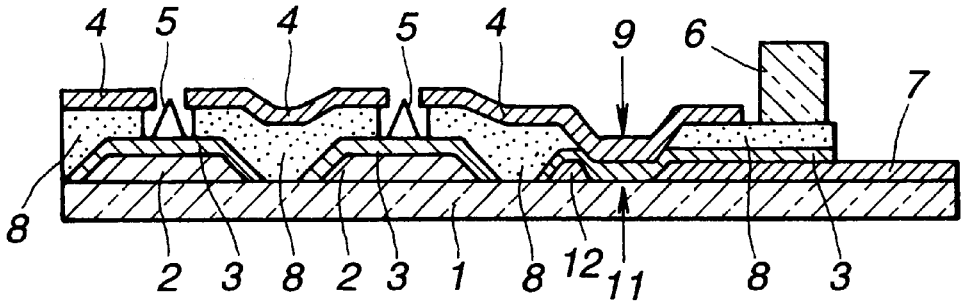
FIG. 5 is a cross-sectional view illustrating a field emission element according to a sixth embodiment of the present invention.

FIG. 5 is a cross-sectional view illustrating a field emission element according to the sixth embodiment of the present invention. Like numerals represent the same constitute elements as those shown in FIGS. 1, 4, 7, and 9. Hence, the duplicate description will be omitted here.

In the present embodiment, the gap 11 is formed under the through hole 9. The electrode-to-terminal resistance is integrated with the terminal resistance.

The resistance value can be easily controlled by adjusting the area of the through hole 9 or the thickness or resistivity of the resistance layer 3.

The resistance value can be widely varied in the resistance decreasing direction, compared with the fourth embodiment shown in FIG. 4 where the electrode-to-electrode resistance and the terminal resistance are differently disposed. Moreover, the resistance layer can be set at large values, compared with the third embodiment shown in FIG. 3 where there are the electrode-to-electrode resistance and the terminal resistance. Even when the length of the gate terminal 7 is short, the gap 11 as length as the through hole 9 can be formed, so that a good space use efficiency can be provided.

The fifth embodiment can omit the step of etching the resistance layer 3 at the time of forming the through hole 9, together with the step of forming the seal protective layer and the step of forming the gate terminal.

Figure 6A:
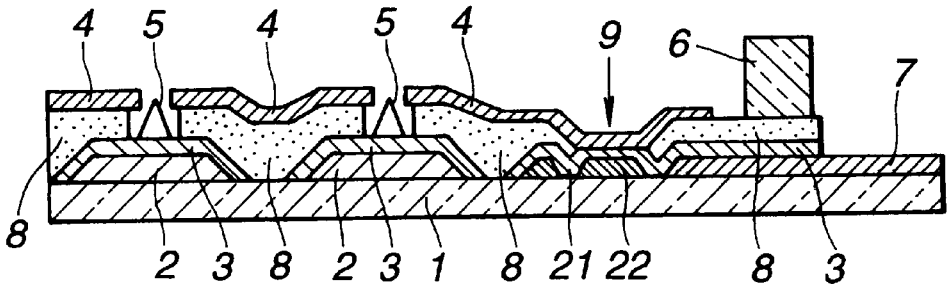
FIG. 6(*a*) is a cross-sectional view illustrating a field emission element according to a seventh embodiment of the present invention.
Figure 6B:
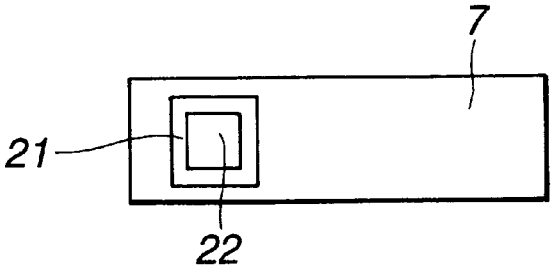

FIG. 6(*a*) is a cross-sectional view illustrating a field emission element of the seventh embodiment of the present invention. FIG. 6(*b*) is a plain view of illustrating a gate terminal. Like numerals represent the same constituent elements as those shown in FIGS. 1, 4, 7, and 9. Hence, the duplicate description will be omitted here. Numeral 21 represents a gap, and 22 represents an island region of a gate terminal.

Unlike the sixth embodiment shown in FIG. 5, the island portion 22 is formed in the gate terminal 7 and under the through hole 9, instead of the gap 11.

As shown in FIG. 6(*b*), the island region 22 is on the same level as the gate terminal 7 and is defined by the gap 21. Current mainly flows from the gate terminal 7 to the gate electrode 4 by way of the resistance layer 3 within the gap 21, the island region 22, and the resistance layer 3 within the through hole 9. As shown in FIG. 6(*a*), since the gap 21 is formed around the island region 22, the resistance therein can be set to a lower resistance value than that of the gap 11 even when the gap 21 has the same spacing as the gap 11 in FIG. 4. The island region 22 can be formed in the line of the gate terminal 7 while the niobium film is patterned on the cathode substrate 1.

As described above, plural cone electrodes 5 can be arranged on each of the flat cathode electrodes 2 via the resistance layer 3. In another manner, plural cone electrodes 5 may be formed on island regions by forming plural island regions acting as cathode electrodes each surrounded with a gap while the lines of the cathode electrodes 2 are being patterned through the etching process and by then respectively forming resistance layers on the cathode electrodes.

In the above description, only the resistance layer 3 is formed to electrically connect the cathode electrode 2 to the cone electrode 5. However, a metal thin film may be formed between the resistance layer 3 and the cone electrode 5.

In any one of the above-mentioned embodiments, when the resistance layer is formed between the cathode electrode and the cone electrode, the resistance film can be incidentally formed on the gate terminal. Since the resistance layer within the through hole can be used without any change, it is not needed to remove the resistance film by the etching process. However, without arranging the resistance layer between the cathode electrode and the cone electrode, the resistance layer may be formed as a resistor for excessive currant protection in the through hole or gap.

As clearly understood from the above-described embodiments, the field emission element according to the present invention has the advantage in that the cathode electrodes and gate electrodes can be lead out at the same level and that an increase of fabrication steps as well as complexity of processes can be avoided. The field emission element can prevent occurrence of excessive current due to a short circuit between the gate electrode and the cathode electrode, so that breakage of the electron emission portion can be effectively avoided. Moreover the field emission element of the present invention can omit the protective film.

The resistance layer within the through hole or gap can be set to a relatively large resistance value. The resistance layer can be widely controlled by changing the width of the gap, thus being set to a suitable resistance value as a gate protective resistor.

When the resistance layer to be disposed between the cathode electrode and the cone electrode is formed on the gate terminal, the resistance layer left within the through hole or the gap can be used as a protective resistor without any change. Hence, the process of etching the resistance film cannot be particularly required.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A field emission element comprising:

a cathode substrate and an anode substrate, said cathode and anode substrates being spaced from each other and are hermetically sealed, cathode electrodes formed on said cathode substrate;

gate terminals formed on said cathode substrate;

an insulating layer overlaying said cathode electrodes and said gate terminals, said cathode electrodes and said gate terminals being partially extracted outward from said insulating layer;

gate electrodes formed on said insulating layer; said gate electrodes being arranged so as to cross said cathode electrodes;

openings formed on said gate electrodes and said insulating layer at each intersection of said gate electrodes and said cathode electrodes;

a resistance layer formed on a part of each of said cathode electrodes;

emitter electrodes formed in said openings, each emitter electrode being electrically connected to said cathode electrode via said resistance layer; and through-holes formed on said insulating layer; wherein each of said gate electrodes is electrically connected to a corresponding one of said terminals via one of said through holes.

2. A field emission element comprising:

a cathode substrate and an anode substrate, said cathode and anode substrate being spaced from each other and hermetically sealed, cathode electrodes formed on said cathode substrate;

gate terminals formed on said cathode substrate;

an insulating layer overlaying said cathode electrodes and said gate terminals, said cathode electrodes and said gate terminals being partially extracted outward from said insulating layer;

gate electrodes formed on said insulating layer; said gate electrodes being arranged so as to cross said cathode electrodes;

openings formed on said gate electrodes and said insulating layer at each intersection of said gate electrodes and said cathode electrodes;

emitter electrodes formed in said openings and electrically connected to said cathode electrodes;

a resistance layer formed on a part of each of said gate terminals; and through-holes formed on said insulating layer; wherein each of said gate electrodes is electrically connected to a corresponding one of said gate terminals via said resistance layer in one of said through holes.

3. A field emission element comprising:

a cathode substrate and an anode substrate, said cathode and anode substrates being spaced from each other and hermetically sealed, cathode electrodes formed on said cathode substrate;

gate terminals formed on said cathode substrate having a connection portion separated with a gap;

an insulating layer overlaying said cathode electrodes and said gate terminals, said cathode electrodes and said gate terminals being partially extracted outward from said insulating layer;

gate electrodes formed on said insulating layer; said gate electrodes being arranged so as to cross said cathode electrodes;

openings formed on said gate electrodes and said insulating layer at each intersection of said gate electrodes and said cathode electrodes;

emitter electrodes formed in said openings and electrically connected to said cathode electrodes;

a resistance layer formed in said gap; and through-holes formed on said insulating layer; wherein each of said gate electrodes is electrically connected to a corresponding connection portion of said gate terminals via one of said through holes.

4. A field emission element comprises:

a cathode substrate and an anode substrate, said cathode and anode substrate being spaced from each other and hermetically sealed, cathode electrodes formed on said cathode substrate;

gate terminals formed on said cathode substrate having a connection portion separated with a gap;

an insulating layer overlaying said cathode electrodes and said gate terminals, said cathode electrodes and said gate terminals being partially extracted outward from said insulating layer;

gate electrodes formed on said insulating layer; said gate electrodes being arranged so as to cross said cathode electrodes;

openings formed on said gate electrodes and said insulating layer at each intersection of said gate electrodes and said cathode electrodes;

emitter electrodes formed in said openings and electrically connected to said cathode electrodes;

a resistance layer formed on a part of said gate terminals and said gap; and through-holes formed on said insulating layer; wherein each of said gate electrodes is electrically connected to a corresponding connection portion of said gate terminals via said resistance layer in one of said through holes.

5. The field emission element as defined in claim 4, wherein said gap is located below said through holes, at a common position, and wherein each of said gate electrodes is electrically connected to said gate terminals via resistance layer in said through hole of insulating layer.

* * * * *